United States Patent [19]

Butler

[11] Patent Number: 4,991,617

[45] Date of Patent: Feb. 12, 1991

[54] GAS INLET VALVE ASSEMBLY FOR INFLATABLE BOATS

[75] Inventor: James R. Butler, Palm Beach, Fla.

[73] Assignee: Seaco, Inc., Riviera Beach, Fla.

[21] Appl. No.: 416,382

[22] Filed: Oct. 3, 1989

[51] Int. Cl.[5] ..... F16K 15/20; F16K 47/00; B01D 39/20

[52] U.S. Cl. ..... 137/223; 137/549; 137/550; 251/127; 446/224

[58] Field of Search ..... 137/223, 549, 550; 251/125, 126, 127; 441/92, 93, 101; 446/220, 224; 410/119; 280/742

[56] References Cited

U.S. PATENT DOCUMENTS

| | | | |
|---|---|---|---|
| Re. 32,560 | 0/1987 | Givens | 441/37 |
| 1,758,625 | 5/1930 | Saul | 137/223 |
| 2,085,369 | 6/1937 | Kilborn | 137/223 |
| 2,342,726 | 2/1944 | Crowley | 132/231 |
| 3,808,981 | 5/1974 | Shaw | 410/119 |
| 3,944,084 | 3/1976 | Reeves | 410/119 |
| 3,975,785 | 8/1976 | Stadeker | 441/93 |
| 3,995,653 | 12/1976 | Mackal et al. | 137/223 |
| 4,073,389 | 2/1978 | Angarola et al. | 137/223 |
| 4,146,069 | 3/1979 | Angarola et al. | 137/223 |
| 4,413,645 | 0/1983 | Seabase et al. | 137/223 |
| 4,478,587 | 0/1984 | Mackal | 441/41 |
| 4,579,141 | 4/1986 | Arff | 137/223 |
| 4,595,374 | 0/1986 | Wass | 441/35 |
| 4,750,447 | 0/1988 | Spinosa et al. | 114/345 |

*Primary Examiner*—John Rivell
*Assistant Examiner*—L. R. Leo
*Attorney, Agent, or Firm*—Eckert, Seamans, Cherin & Mellott

[57] ABSTRACT

A gas inlet valve assembly for inflatable boats includes valve structure having at least one inlet opening and at least one outlet opening. A valve member is positionable between the inlet opening and the outlet opening to control the flow of gas through the valve. A gas dispersion member, preferably made of a porous material, is provided with the valve and is substantially adjacent to the valve outlet opening, such that gas emanating from the valve outlet opening will be thrust into contact with the gas dispersion member. The expanding, cold gas jet is dispersed by the porous material of the gas dispersion member. Direct contact between the cold gas jet and raft surfaces, together with freezing and cracking associated therewith, will thereby be substantially prevented. In a preferred embodiment, a pluraity of radially-disposed outlet valve openings are provided, and the gas dispersion member is substantially annular. The valve outlet openings are disposed substantially adjacent to the open interior of the annular gas dispersion member, such that the cold gas jets emanating from the valve outlet openings will be thrust into contact with the interior annular surface of the gas dispersion member.

10 Claims, 2 Drawing Sheets

GAS INLET VALVE ASSEMBLY FOR INFLATABLE BOATS

BACKGROUND OF THE INVENTION

1. Field of the Invention

This invention relates generally to inflatable boats, and more particularly to gas inlet valve apparatus for inflatable boats.

2. Description of the Prior Art

Inflatable boats, and particularly life rafts, are most commonly stored in the deflated, folded configuration. Compressed inflation gas, often carbon dioxide, is provided in bottles associated with the life rafts, and is released into inflation chambers of the life raft by manipulation of a pull-cord or other device. The compressed gas flows through a suitable conduit into one or more of the inflation chambers. Check valves at the point of entry into the inflation chambers keep the gas sealed within the inflation chambers. These check valves typically have a valve body with at least one inlet opening, one or more outlet openings, and a check valve member disposed between the inlet opening and the outlet openings. The compressed gas is typically under great pressure so as to rapidly inflate the inflation chamber. These pressures can be in excess of 9,000 psi. The compressed gas expands upon entering the inflation chamber, and undergoes a very great pressure change which cools the gas to very cold temperatures. Gas jets emanating from the outlet openings impact directly on adjacent wall portions of the inflation chamber, and the very cold temperatures can cause freezing and cracking of these areas. Also, rapid inflation will cause icing of the carbon dioxide, and ice formation in the inflation chamber and on the inlet check valve. These are especially significant problems where the life raft is to be used in very cold climates, and air temperatures can be −60 degrees F., or less.

Apparatus have been provided to alleviate the problem caused when cold inflation gases impact inflation chamber surfaces. One such apparatus is an elongated, porous sleeve having a longitudinal passage and a side opening. The sleeve is positioned over the gas inlet valve with the outlet openings within the side opening of the sleeve. Gas emanating from the outlet openings passes axially through the longitudinal passage toward either end of the sleeve, and is dispersed through the sleeve material into the inflation chamber. The sleeve must be of a relatively large dimension, usually more than two feet in length, is expensive to manufacture, and is difficult to store within a compact, folded, and deflated life raft construction.

SUMMARY OF THE INVENTION

It is an object of the invention to provide an inlet valve assembly for inflatable boats which will prevent cracking of inflation chamber surfaces during the inflation process.

It is another object of the invention to provide an inlet valve assembly for inflatable boats which will prevent icing of inflation gases.

It is still another object of the invention to provide an inlet valve assembly for inflatable boats which will prevent ice formation both in the inflation chamber, and on the inlet check valve.

It is another object of the invention to provide an inlet valve assembly for inflatable boats which will function in very cold atmospheric conditions.

It is still another object of the invention to provide an inlet valve assembly for inflatable boats which will be comparatively inexpensive to manufacture.

It is yet another object of the invention to provide an inlet valve assembly for inflatable boats which will be compact and easily stored within the folded, deflated inflatable boat.

These and other objects are accomplished by a gas inlet valve assembly having a valve body with at least one inlet opening, at least one outlet opening, and a check valve member between the inlet opening and the outlet opening. A gas dispersion member, preferably made of a porous material, is provided substantially adjacent to each of the outlet openings. The cold gas jets emanating from the outlet openings will pass through the porous material of the gas dispersion member, and will be dispersed into many smaller gas currents. The cold gas jets will be sufficiently dispersed such that no single area of the inflation chamber will become disproportionately cooled, and cracking of these areas will be substantially prevented.

A plurality of radially-disposed outlet openings are preferably provided, and the gas dispersion member is preferably annular. The valve outlet openings are disposed substantially adjacent to the open interior space of the annular gas dispersion member, and are directed such that the cold gas jets emanating from the valve outlet openings will be thrust into contact with the interior annular surface of the gas dispersion member.

The gas inlet valve assembly can include a seal member, which preferably extends radially outwardly from the valve body. The seal member is glued or otherwise sealably fastened to surrounding portions of the inflation chamber to provide a tight seal at the point of connection between the valve and the inflation chamber. The annular gas dispersion member can be fixed directly to this seal member by suitable fastening means such as adhesives.

The material of the gas dispersion member can be selected from a number of materials that are suitable to disperse a jet of gas passing through the material. Felt and fiberglass are presently preferred materials, however, other natural, synthetic or composite materials could also be utilized.

The gas dispersion member can take several alternative shapes, although the annular shape is particularly well-adapted for radially-directed valve outlet openings. The annular gas dispersion member is preferably open-ended, as a closed end could create significant back pressure.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
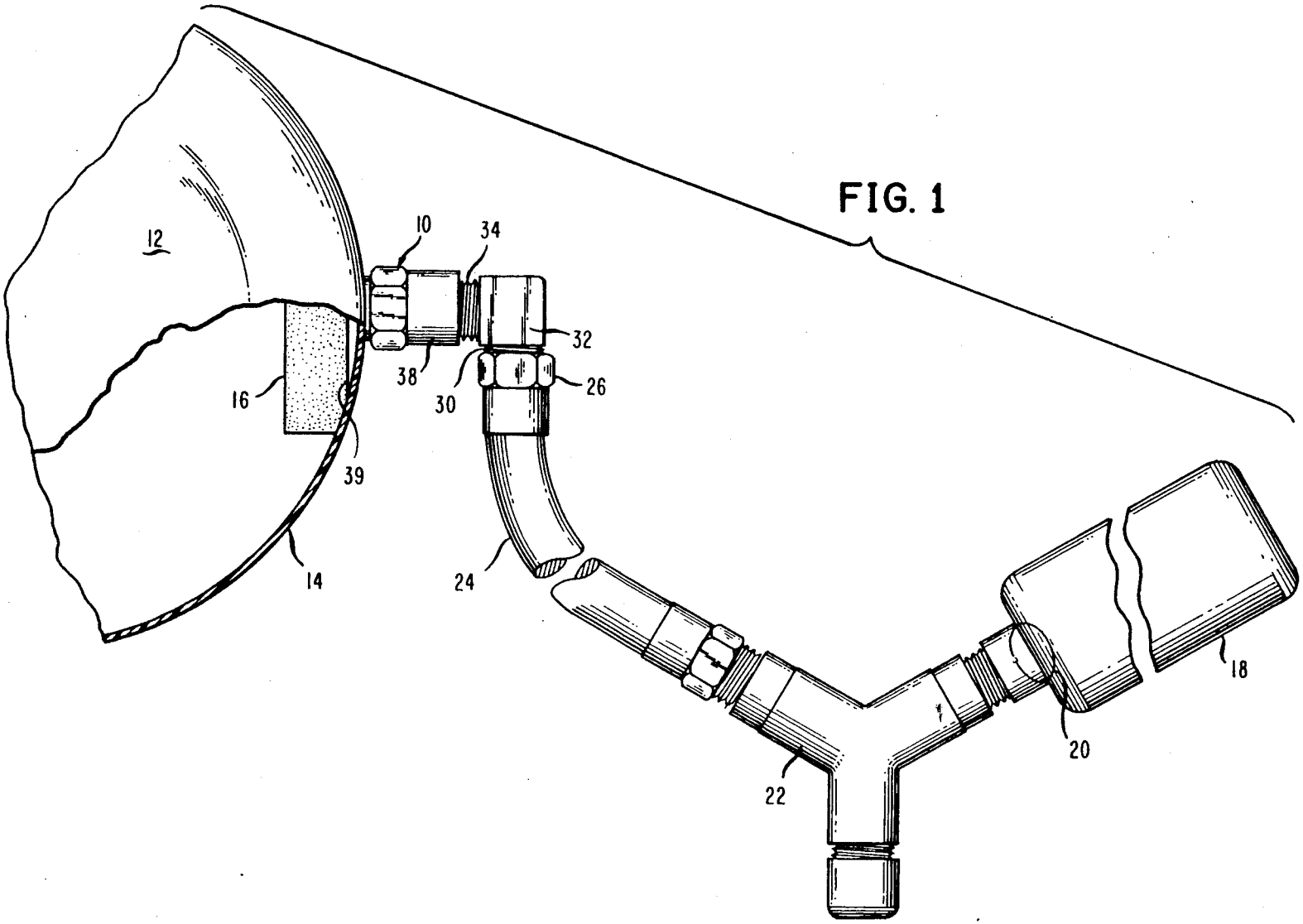
FIG. 1 is a side elevation, partially broken away, of a portion of an inflatable boat according to the invention.
Figure 3:
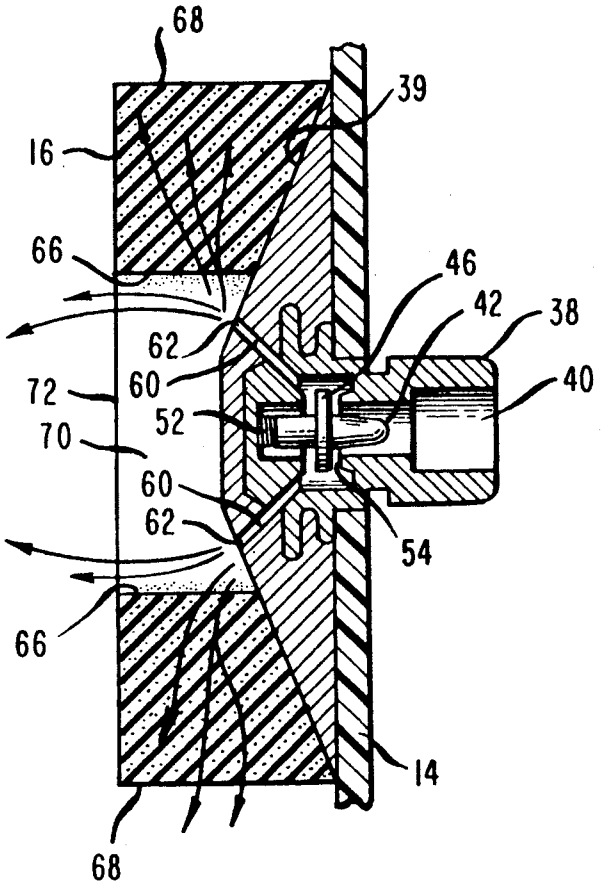
FIG. 3 is a cross-section taken along lines 3—3 in FIG. 2.
Figure 2:
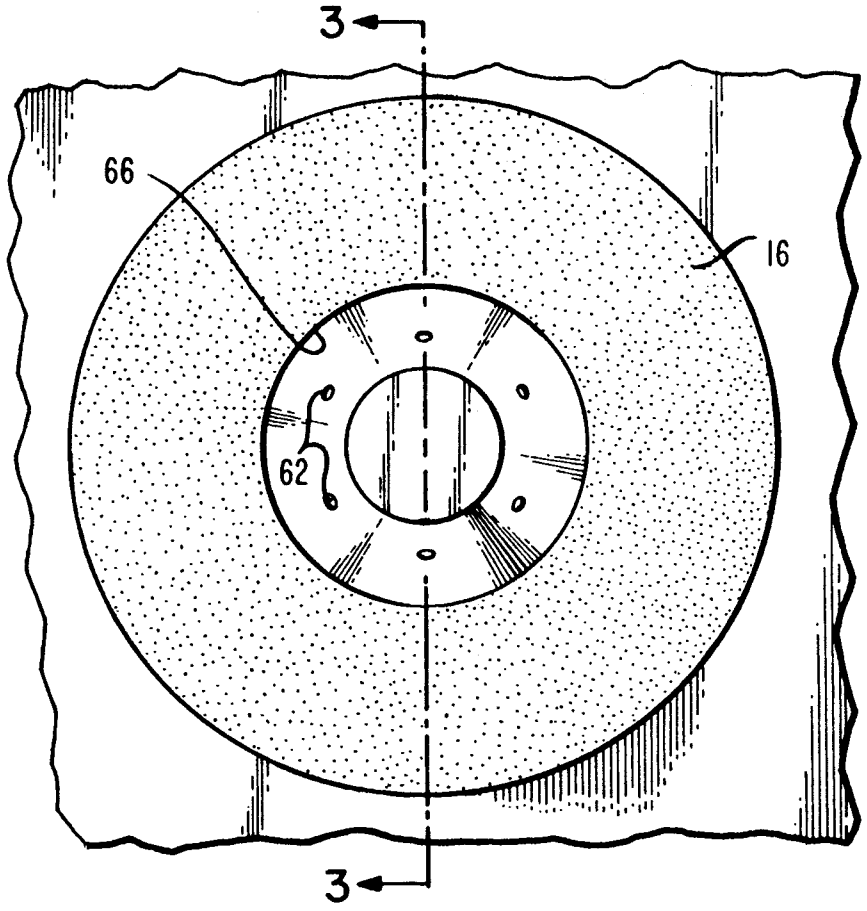
FIG. 2 is a plan view of an inlet valve assembly according to the invention.

There are shown in FIGS. 1–3 an inlet valve assembly for inflatable boats according to the invention. The inlet check valve 10 is commonly provided as a means for introducing compressed gas into an inflation chamber 12 of an inflatable boat, which chamber is defined by walls 14. A gas dispersion member 16, to be described, is fitted to the check valve 10. The check valve 10 receives compressed gas from a suitable compressed gas source such as the bottle 18 whenever the bottle 18 is opened, as by the pull-ring 20. The gas can flow through a fitting 22 into high-pressure conduit 24, and through the high pressure conduit 24 into an elbow fitting 32. Suitable attachment structure such as the female fitting 26 and male threads 30 can be used to secure the components together. Male threads 34 of the elbow fitting 32 ca be used to attach the elbow fitting 32 to the body 38 of the inlet valve 10.

High-pressure gas enters the valve body 38 through an inlet opening 40 (FIG. 3). A check valve member 42 includes sealing flanges 46 which, under the action of suitable biasing structure such as the spring 52, contact a valve seat 54. High pressure gas from the bottle 18 drives the valve member 42 away from its seat 54. The gas then flows around the valve member 42 and can flow out of one of the preferably radially-directed outlet paths 60 and the cooperating outlet openings 62.

The gas dispersion member 16 can be selected from several devices and materials suitable to disperse a concentrated jet of gas into several smaller gas currents that are divergent to one another. The gas dispersion head 16 should not markedly interfere with gas flow and create significant back pressure. This back pressure can cause icing and failure of the valve.

Porous materials with many internal flow paths, and that allow the gas to pass through and disperse a gas jet into several smaller, divergent currents, are presently preferred for the gas dispersion member 16.

One such presently preferred material is felt. Other suitable materials would include fiberglass and other porous, natural, synthetic and composite materials. Baffles or other dispersing structures positioned immediately adjacent the outlet openings might also be suitable.

A portion of the gas dispersion member 16 should be adjacent to each of the outlet openings 62. The outlet openings 62 are radially-disposed in many gas inlet valves to provide a more even distribution of gas from the valve. It has been found that an annular gas dispersion member, such as the member 16, is desirable for use with such valve configurations. The annular gas dispersion member 16 has an interior annular surface 66, an exterior annular surface 68, and an open interior 70 with at least one open end 72.

The gas dispersion member 16 is provided on the valve 10, such that the radially-disposed outlet openings 62 are within or substantially adjacent to the open interior 70. The very cold gas leaving the outlet openings 62 impinges upon the interior annular surface 66 of the gas dispersion member 16. Some of this gas flows through the porous gas dispersion member 16, where it is dispersed into many smaller currents of flowing gas (arrows in FIG. 3). The very cold, high-pressure gas jets leaving the outlet openings 62 are thereby dispersed and do not directly impinge upon adjacent portions of the walls 14 of the inflation chamber 12 in a manner likely to cause disproportionate cooling, and thereby cracking. The rate of inflation is also controlled to prevent ice formation in the inflation chamber and on the inlet valve.

It is presently preferred to provide an open end 72 in the annular gas dispersion head 16. Portions of the high-pressure jets emanating from the outlet openings 62 are deflected by the interior annular surface 66 and pass through the open end 72 (arrows in FIG. 3). It is presently believed that the open end 72 will thereby prevent the creation of significant back pressure, as would be likely to cause icing and failure of the valve.

A seal member 39 can be provided with the valve 10, and can be disk-shaped as shown. The seal member 39 preferably extends outwardly from the valve body 38, and is adhered to adjacent portions of the raft wall 14 to provide an effective attachment and seal between the valve 10 and the raft wall 14.

The dimensions of the gas dispersion member 16 can be varied, and most likely will be determined empirically. It is preferable that the outside diameter of the gas dispersion member 16 not substantially exceed the dimensions of the seal member 39, as it is most convenient to secure the gas dispersion member 16 directly to the seal member 39 by suitable means including adhesives. The interior annular surface 66 should have a diameter sufficient to space portions of this surface from adjacent outlet openings 62 a distance which will not create back pressure at the valve opening 62 and interfere with the proper flow of gas through the valve. This dimension will also likely be determined empirically for the particular temperatures, inflation gases and pressures, and valve configurations of any particular embodiment.

It is possible to manufacture the gas dispersion member 16 in alternative forms, so long as the gas jets emanating from the outlet opening 62 impinge on portions of the gas dispersion member 16. A plurality of gas dispersion members, each adjacent an outlet opening 62, could alternatively be provided. It is also possible to use the gas dispersion principles of the invention with other inlet valve constructions.

This invention can be embodied in other specific forms without departing from the spirit or essential attributes thereof, and accordingly, reference should be had to the following claims, rather than to the foregoing specification, as indicating the scope of the invention.

I claim:

1. An inlet valve assembly for inflating an inflatable boar, comprising: a valve body, said valve body comprising at least one inlet opening and a plurality of radially-oriented outlet openings, a check valve member positionable between the inlet opening and the outlet openings to control flow of gas through the valve body, and comprising means for biasing said valve member to close said inlet opening of said valve body, said valve body comprising a seal member for attaching said valve body to said inflatable boat, said outlet openings producing a jet of gas during inflation;

a gas dispersion member adjacent said outlet opening and being fixed to said seal member, and having a position whereby said gas jet emanating from said outlet opening will impinge upon said gas dispersion member, said gas dispersion member being adapted to disperse said jets into a plurality of smaller flow currents, whereby direct contact between said gas jets and adjacent portions of said inflatable boat will be substantially prevented, said gas dispersion member being annular with an open interior and interior and exterior annular surfaces, said outlet openings being positioned substantially adjacent said open interior, whereby gas emanating said outlet openings will impact said interior surface of said annulus.

2. An inlet valve assembly for inflating an inflatable boat, comprising;

a valve body, said valve body comprising at least one inlet opening and a plurality of radially-oriented outlet openings, a check valve member positionable between the inlet opening and the outlet openings to control flow of gas through the valve body, the valve body comprising means for biasing said valve member to close said inlet opening of said valve body, said outlet opening producing a jet of gas during inflation;

a gas dispersion member adjacent said outlet openings, and having a position whereby said gas jet emanating from said outlet opening will impinge upon said gas dispersion member, said gas dispersion member comprising an annulus having an open interior, and interior and exterior annular surfaces, said radially-disposed outlet openings being substantially adjacent said open interior of said annulus and substantially directed at said interior annular surface, whereby gas jets emanating from said outlet openings impact said interior annular surface and are dispersed into a plurality of smaller currents, and whereby direct contact between said gas jet and adjacent portions of said inflatable boat will be substantially prevented.

3. The inlet valve assembly of claim 2, further comprising a substantially disk-shaped seal member extending radially outwardly from said valve body for attachment to adjacent portions of said inflatable boat, said gas dispersion member being fixed to said seal member.

4. An inlet valve assembly for inflating an inflatable boat, comprising:

a valve body, said valve body comprising at least one inlet opening and at least one outlet opening, and a valve member positionable between the inlet opening and the outlet opening to control flow of gas through the valve body, and comprising means for biasing the valve member to close said inlet opening of said valve body, said outlet opening producing a jet of gas during inflation;

a gas dispersion member adjacent said outlet opening, said gas dispersion member comprising at least one of the group consisting of felt and fiberglass, and having a position whereby said gas jet emanating from said outlet opening will impinge upon said gas dispersion member, said gas dispersion member being adapted to disperse said jets into a plurality of smaller flow currents, whereby direct contact between said gas jet and adjacent portions of said inflatable boat will be substantially prevented.

5. An inlet check valve assembly for inflatable boats, comprising:

a check valve body having an inlet opening, a plurality of substantially radially-disposed outlet openings, a flow passage between the inlet opening and the outlet openings, a check valve member disposed in the flow passage between the inlet opening and the outlet openings, said check valve member having biasing means adapted to bias said check valve member to close the inlet opening;

a substantially disk-shaped seal member having first and second sides and being radially-disposed about the valve body, said outlet openings being disposed on said first side of said seal member; and, a circumferentially enclosed, porous gas dispersion member fixed to said first side of said seal member and having an open interior defined by an interior surface, said outlet openings being disposed substantially adjacent said open interior and substantially directed at said interior surface, whereby cold gas jets emanating from said outlet openings will impact said interior surface and will be dispersed into a plurality of flow currents, whereby said gas jets will not directly impinge upon adjacent inflatable boat portions.

6. The inlet valve assembly of claim 5, wherein said porous gas dispersion member comprises a material selected from the group consisting of felt and fiberglass.

7. An inflatable boat, comprising;

at least one inflation chamber comprised substantially of hermetically sealed flexible walls;

at least one container of pressurized inflation gas;

at least one check valve mounted to a portion of said flexible walls of said inflation chamber, said check valve having a check valve body comprising at least one inlet opening and a plurality of radially-oriented outlet openings, a flow passage between the inlet opening and the outlet openings, and a valve member positionable between the inlet opening and the outlet openings and biased to close said flow passage, said outlet opening producing a jet of gas during inflation, said valve body comprising a seal member for attaching said valve body to said inflatable boat;

a porous gas dispersion member fixed to said seal member and positioned immediately adjacent said outlet openings such that said gas jet emanating from said outlet opening will impinge upon said gas dispersion member, said gas dispersion member being adapted to disperse said gas jet into a plurality of smaller flow currents, said gas dispersion member being annular with an open interior and interior and exterior annular surfaces, said outlet openings being positioned substantially adjacent said open interior and directed substantially at said interior annular surface; and, fluid connection means between said compressed gas container and said inlet opening of said valve body, whereby gas emanating from said outlet openings will impact said interior surface of said annulus, and whereby at least a portion of said gas jet will flow through said porous gas dispersion member and will be dispersed into a plurality of smaller flow currents such that direct contact between said gas jet and adjacent portions of said inflatable boat will be substantially prevented.

8. An inflatable boat, comprising:

at least one inflation chamber comprised substantially of hermetically sealed flexible walls;

at least one container of pressurized inflation gas;

at least one check valve mounted to a portion of said flexible walls of said inflation chamber, said check valve having a check valve body comprising at least one inlet opening and a plurality of substantially radially-oriented outlet openings, a flow passage between the inlet opening and the outlet openings, and a valve member positionable between the inlet opening and the outlet opening and biased to close said flow passage, said outlet opening producing a jet of gas during inflation;

a gas dispersion member adjacent said outlet opening, such that said gas jet emanating from said outlet openings will impinge upon said gas dispersion member, said gas dispersion member being adapted to disperse said gas jet into a plurality of smaller flow currents, whereby direct contact between said gas jet and said adjacent portions of said inflatable boat will be substantially prevented, said gas dispersion member comprising an annulus having an opening interior, and interior and exterior annular surfaces, said radially-disposed outlet openings being substantially adjacent said open interior of said annulus and directed substantially at said interior annular surface, whereby gas jets emanating from said outlet openings will impact said interior annular surface and will be dispersed into a plurality of smaller currents; and fluid connection means between said compressed gas container and said inlet opening of said valve body.

9. The inlet valve assembly of claim 8, further comprising a substantially disk-shaped seal member extending radially outwardly from said valve body for attachment to adjacent portions of said inflatable boat, said gas dispersion member being fixed to said seal member.

10. An inflatable boat, comprising:

at least one inflation chamber comprised substantially of hermetically sealed flexible walls;

at least one container of pressurized inflation gas;

at least one check valve mounted to a portion of said flexible walls of said inflation chamber, said check valve having a check valve body comprising at least one inlet opening and at least one outlet opening, a flow passage between the inlet opening and the outlet opening, and a valve member positionable between the inlet opening and the outlet opening and biased to close said flow passage, said outlet opening producing a jet of gas during inflation;

a gas dispersion member adjacent said outlet opening, such that said gas jet emanating from said outlet opening will impinge upon said gas dispersion member, said gas dispersion member being adapted to disburse said gas jet into a plurality of smaller flow currents, whereby direct contact between said gas jet and adjacent portions of said inflatable boat will be substantially prevented, said gas dispersion member comprising a material selected from at least one of the group consisting of felt and fiberglass.

* * * * *

UNITED STATES PATENT AND TRADEMARK OFFICE

CERTIFICATE OF CORRECTION

PATENT NO. : 4,991,617

DATED : February 12, 1991

INVENTOR(S) : JAMES R. BUTLER

It is certified that error appears in the above-identified patent and that said Letters Patent is hereby corrected as shown below:

On the title page:

In the Abstract, line 17, that portion of the line which states "pluraity" should state --plurality--;

In Column 3, line 19, that portion of the line which states "ca" should state --can--.

In Claim 1, column 4, line 49, that portion of the claim which states "boar" should state --boat--.

Signed and Sealed this

Fifteenth Day of November, 1994

*Attest:*

*Attesting Officer*

BRUCE LEHMAN

*Commissioner of Patents and Trademarks*